US009024162B2

(12) United States Patent
Yovino

(10) Patent No.: US 9,024,162 B2
(45) Date of Patent: May 5, 2015

(54) TABLA DRUM HEAD TENSIONING SYSTEM AND METHOD

(76) Inventor: David Yovino, San Rafael, CA (US)

( * ) Notice: Subject to any disclaimer, the term of this patent is extended or adjusted under 35 U.S.C. 154(b) by 302 days.

(21) Appl. No.: 13/601,811

(22) Filed: Aug. 31, 2012

(65) Prior Publication Data

US 2014/0060286 A1 Mar. 6, 2014

(51) Int. Cl.
*G10D 13/02* (2006.01)

(52) U.S. Cl.
CPC ..... *G10D 13/023* (2013.01)

(58) Field of Classification Search
USPC ..... 84/411 R, 413–415, 421
See application file for complete search history.

(56) References Cited

U.S. PATENT DOCUMENTS 4,077,297 A * 3/1978 Woodson ..... 84/411 R
4,674,390 A * 6/1987 Allen et al. ..... 84/419
2010/0300261 A1 12/2010 Krishnamurthy

OTHER PUBLICATIONS

"Tabla" downloaded and printed from http://www.mid-east.com/lnfo/tablas.html bearing copyright notice: Copyright © 2001-2006 Mid-East Mfg., Inc., and printed Mar. 25, 2013.

* cited by examiner

*Primary Examiner* — Kimberly Lockett
(74) *Attorney, Agent, or Firm* — Patent Law Offices of Michael E. Woods; Michael E. Woods

(57) ABSTRACT

A system and method for quickly and efficiently installing a drum head on a tabla and controlling the tension of individual segments simultaneously. A mechanical interface controls a tension on each of a set of connective elements of a connective assembly that joins the drum head to the mechanical interface. Operation of the mechanical interface adjusts the tension of all elements of the connective assembly, and thus adjusts a playing tension of the drum head, at the same time.

9 Claims, 9 Drawing Sheets

TABLA DRUM HEAD TENSIONING SYSTEM AND METHOD

FIELD OF THE INVENTION

The present invention relates generally to membranophones, and more specifically, but not exclusively, to the tabla drum and related percussion devices including the pakhavaj, mridangam, and khol.

BACKGROUND OF THE INVENTION

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

Tabla and related percussion devices include a generally cylindrical tapering body made from medium hard wood having an interior cavity with a top opening. For the tabla, a skin drum head is installed over the top opening and attached by a single very long strip of thin leather. The drum head includes sixteen holes that are evenly spaced around its perimeter. A bottom rawhide ring is installed over a bottom portion of the body directly opposing the top opening. The leather strip is laced back and forth through the holes of the drum head and around the bottom rawhide until the perimeter of the drum head is completely attached.

Tuning is achieved by stretching the drum head through proper tensioning of the leather strip. To aid in the tensioning, eight tabla blocks are held under the lacing. These blocks are tapped with a tuning hammer to slacken or stretch the leather strip. Movement of the blocks alters the pitch of the drum. Tapping the blocks lower, increases the tension on the leather strip and drum head, and raises the pitch of the drum. Fine tuning can be achieved by tapping the edge of the drum head or leather strip. It is important to have equal tension around the drum for proper tuning.

Simply the attachment and initial tensioning of the drum head is a long and arduous process. Significant force is required to properly tension the leather strip. In the traditional style, each element of slack is taken up by propagating that slack to the end of the leather strip. It can easily take several hours to attach and tension a drum head. Significant force is used over that time, often exhausting the person at the conclusion of the attachment process.

A number of drawbacks arise from this arrangement, in addition to the significant time required to install a drum head. The drum head, leather strip, and rawhide ring are prone to stretch. This means that the elements must be continually adjusted by providing individual attention to each segment of the leather strip, further decreasing the amount of time that the operator may spend actually playing the instrument. Part of the gross adjustment includes moving the tabla blocks downward. Eventually the blocks reach the bottom and must be reinstalled at the top, usually installing these blocks under a greater number of segments.

For many players, it is sometimes desirable to change the pitch of the drum for particular musical pieces. However the time required to adjust the pitch through the propagation of proper tension among the various segments of the leather strip make it impractical to adjust the pitch during a performance. The player either must always use the same pitch, or use multiple drums all tuned to different pitches. The more drums a player has, the entire time investment increases exponentially.

Another challenge is that the drum head is actually a special multilayer assembly. Due to materials or manufacturing variations, the characteristics of a drum head may not be evaluated until it is actually installed and tested. To install and test the drum head, the long and arduous process described above must be performed. It is not uncommon that a newly installed drum head fails to perform adequately and must then be replaced, again with the uncertainty of its characteristics. This is undesirable from the perspective of the player, manufacturer, and retailer.

A turnbuckle solution is infrequently used in which sixteen discrete adjustable straps are applied to the drum head and rawhide ring. Each turnbuckle must be independently adjusted. This solution is problematic because of the amount of time necessary, the bulky mechanism required, the loss of the tuning pegs in the system, drilling into the side of the drum shell (which can both damage it and change the acoustics), and altering the aesthetics of the drum.

What is needed is a system and method for quickly and efficiently installing a drum head on a tabla and controlling the tension of individual segments simultaneously.

BRIEF SUMMARY OF THE INVENTION

Disclosed is a system and method for quickly and efficiently installing a drum head on a tabla and controlling the tension of individual segments simultaneously.

The following summary of the invention is provided to facilitate an understanding of some of technical features related to tensioning and tuning a drum head, and is not intended to be a full description of the present invention. A full appreciation of the various aspects of the invention can be gained by taking the entire specification, claims, drawings, and abstract as a whole. The present invention is applicable to other drums other than the Tabla, including drums with solid closed bases.

A tensioning assembly for a drum head installed on a proximal end of a drum body, including a mechanical interface coupled to a distal end of the drum body, said distal end opposite of the proximal end, said mechanical interface including a coupler and a tension control; and a connective assembly, uniformly coupled to the drum head and said coupler, including a plurality of connective elements that extend from said coupler to the drum head wherein said connective assembly is responsive to said tension control to uniformly adjust a tension of said plurality of connective elements all at the same time.

A tabla, including a drum body defining a longitudinal cavity with an opening at a proximal end; a drum head disposed over said opening; a mechanical interface coupled to a distal end of said drum body, said distal end longitudinally opposite of said proximal end, said mechanical interface including a coupler and a tension control; and a connective assembly, uniformly coupled to said drum head and said coupler, including a plurality of connective elements that extend from said coupler to said drum head wherein said connective assembly is responsive to said tension control to uniformly and concurrently adjust a tension of said plurality of connective elements.

A tensioning method for a drum head installed on a proximal end of a drum body, including coupling a mechanical interface to a distal end of the drum body, said distal end opposite of the proximal end, said mechanical interface including a coupler and a tension control; coupling uniformly a connective assembly to the drum head and to said coupler, with said connective assembly including a plurality of connective elements that extend from said coupler to the drum head; and adjusting uniformly and concurrently, responsive to said tension control, a tension of said plurality of connective elements.

Any of the embodiments described herein may be used alone or together with one another in any combination. Inventions encompassed within this specification may also include embodiments that are only partially mentioned or alluded to or are not mentioned or alluded to at all in this brief summary or in the abstract. Although various embodiments of the invention may have been motivated by various deficiencies with the prior art, which may be discussed or alluded to in one or more places in the specification, the embodiments of the invention do not necessarily address any of these deficiencies. In other words, different embodiments of the invention may address different deficiencies that may be discussed in the specification. Some embodiments may only partially address some deficiencies or just one deficiency that may be discussed in the specification, and some embodiments may not address any of these deficiencies.

Other features, benefits, and advantages of the present invention will be apparent upon a review of the present disclosure, including the specification, drawings, and claims.

BRIEF DESCRIPTION OF THE DRAWINGS

The accompanying figures, in which like reference numerals refer to identical or functionally-similar elements throughout the separate views and which are incorporated in and form a part of the specification, further illustrate the present invention and, together with the detailed description of the invention, serve to explain the principles of the present invention.

DETAILED DESCRIPTION OF THE INVENTION

Embodiments of the present invention provide a system and method for quickly and efficiently installing a drum head on a tabla and controlling the tension of individual segments simultaneously. The following description is presented to enable one of ordinary skill in the art to make and use the invention and is provided in the context of a patent application and its requirements.

Various modifications to the preferred embodiment and the generic principles and features described herein will be readily apparent to those skilled in the art. Thus, the present invention is not intended to be limited to the embodiment shown but is to be accorded the widest scope consistent with the principles and features described herein.

Figure 1:
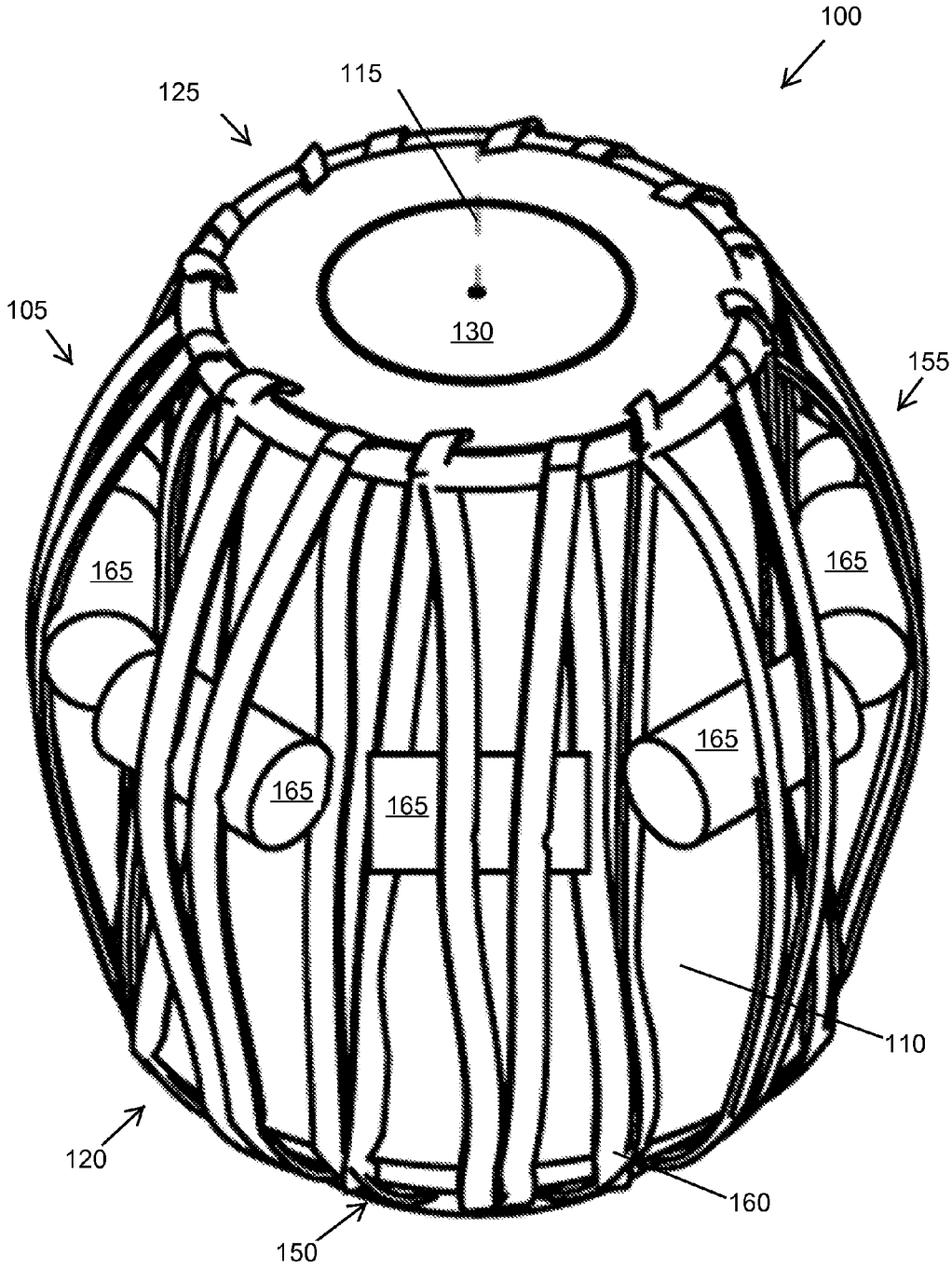
FIG. 1 illustrates a perspective view of a tabla including a head tensioning system.
Figure 2:
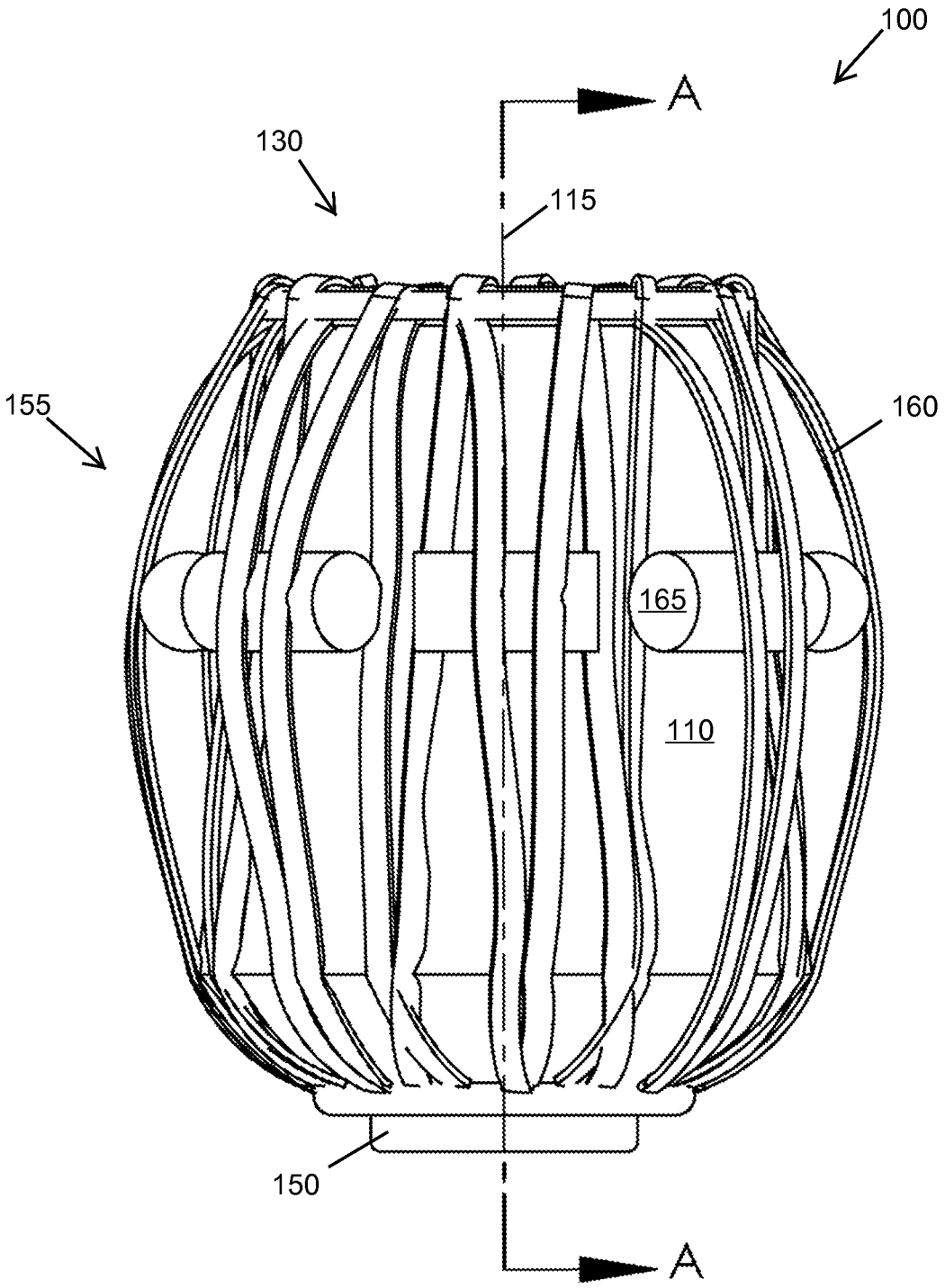
FIG. 2 illustrates a side view of the tabla of FIG. 1.
Figure 3:
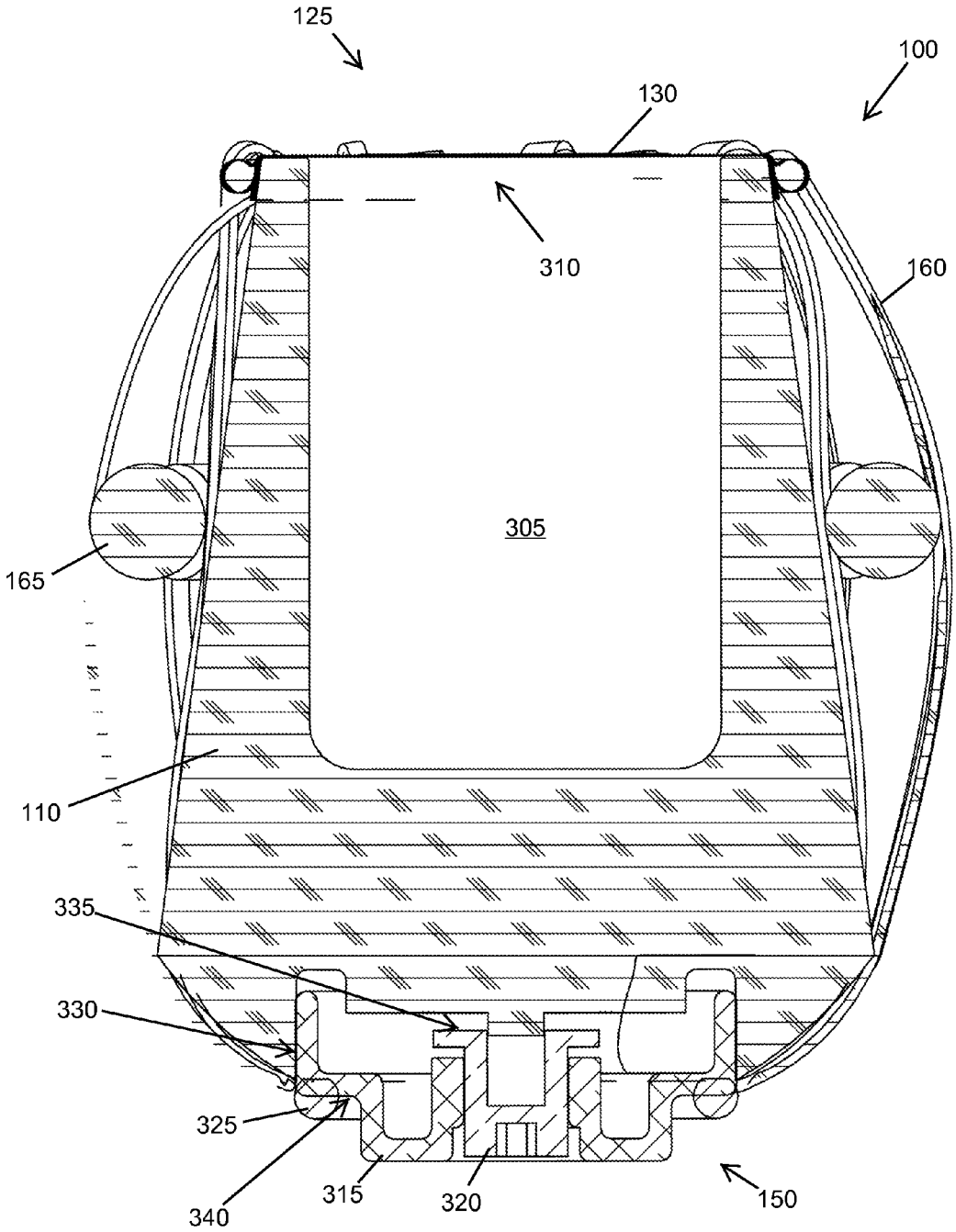
FIG. 3 illustrates a cross-sectional view of the tabla of FIG. 2.
Figure 4:
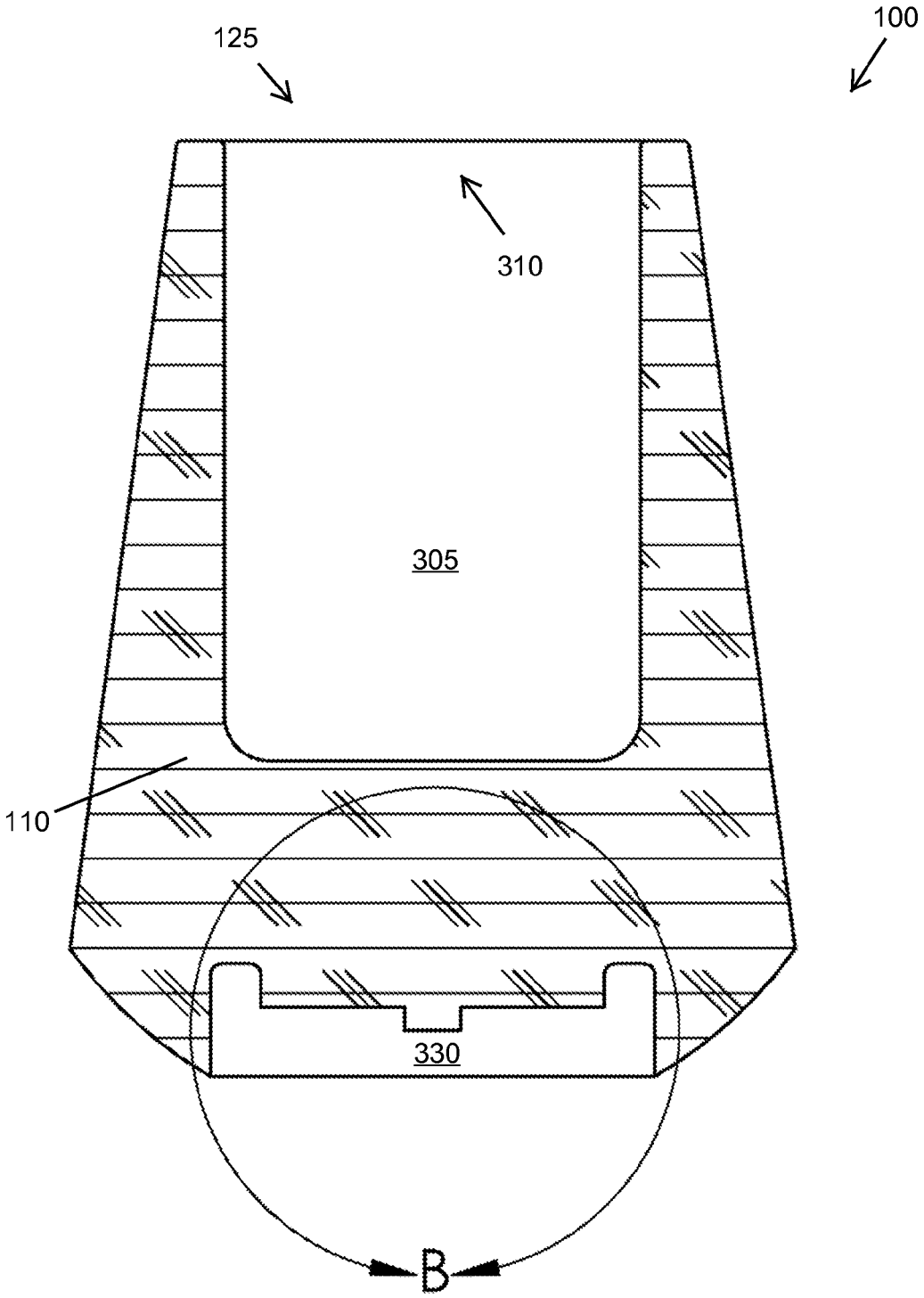
FIG. 4 illustrates a cross-sectional view of the tabla without the mechanical interface.

An overview of components of an embodiment of the present invention is provided by reference to FIG. 1-FIG. 4. FIG. 1 illustrates a perspective view of a tabla 100 including a head tensioning system 105. FIG. 2 illustrates a side view of tabla 100 and FIG. 3 illustrates a cross-sectional view A-A. FIG. 4 illustrates a cross-sectional view of tabla 100 without head tensioning system 105.

Tabla 100 includes a generally cylindrical body 110 typically made of medium hard wood, but other materials may be used in its construction. Body 110 includes a radial symmetry about a longitudinal axis 115 extending from a bottom 120 to a top 125. A drum head 130 is attached to top 125 and held in place and tensioned by head tensioning system 105. Drum head 130 typically includes a number of lacing apertures (e.g., 16) evenly spaced about the perimeter.

Head tensioning system 105 includes a mechanical interface 150 and a connective assembly 155. Mechanical interface 150 is configured to be installed at bottom 120 and is coupled to connective assembly 155. Connective assembly 155 includes a single long elongate member 160 that is laced back and forth between drum head 130 and mechanical interface 150 using the lacing apertures. Elongate member 160 is an appropriate connecting structure, that includes one or more of leather thong, a rawhide strap, a lace, a flat nylon webbing, a nylon rope, a metal wire, a metal cable, a plastic cord, a string, combinations thereof, and the like. Connected assembly 155 forms a plurality of segments (e.g., 32 segments for drum head 130 including the 16 lacing apertures) extending between drum head 130 and mechanical interface 150. A plurality of tuning blocks 165 (e.g., 8) are inserted between body 110 and selected lace segments of connective assembly 155.

As discussed in more detail below, mechanical interface 150 operates to selectively extend and retract relative to longitudinal axis 115. The extension and retraction of mechanical interface 150 influences the pitch of drum head 130 by selectively and evenly increasing tension (extension) and decreasing tension (retraction) of all segments of connective assembly 155 at the same time. Moving tuning blocks 165 longitudinally also influences pitch within parameters set by the tension applied by mechanical interface 150.

In FIG. 3, body 110 defines an interior cavity 305 accessible through an opening 310 at top 125. Drum head 130 is installed over opening 310. FIG. 3 also illustrates mechanical interface 150 including a mechanical interface body 315, a mechanical interface adjustor 320, and a mechanical interface coupler 325. Bottom 320 is provided with a radially symmetric aperture 330 configured to operationally receive mechanical interface 150.

Components of mechanical interface 150 are preferably made from strong, rigid materials, stainless steel, aluminum, composite, or the like. The materials are constructed to endure the forces that result from application of the tensioning forces to connective assembly 155 without failure or degradation. Adjustor 320 is threadingly engaged to body 315 for converting rotation into linear motion. Coupler 325 captures connective assembly 155 to body 315 and evenly distributes tensioning forces applied by body 315 responsive to rotation of adjustor 320. Body 315 and coupler 325 both include a circular perimeter to enhance uniform loading, though some embodiments may employ other perimeter shapes appropriate for the implementation.

Figure 5:
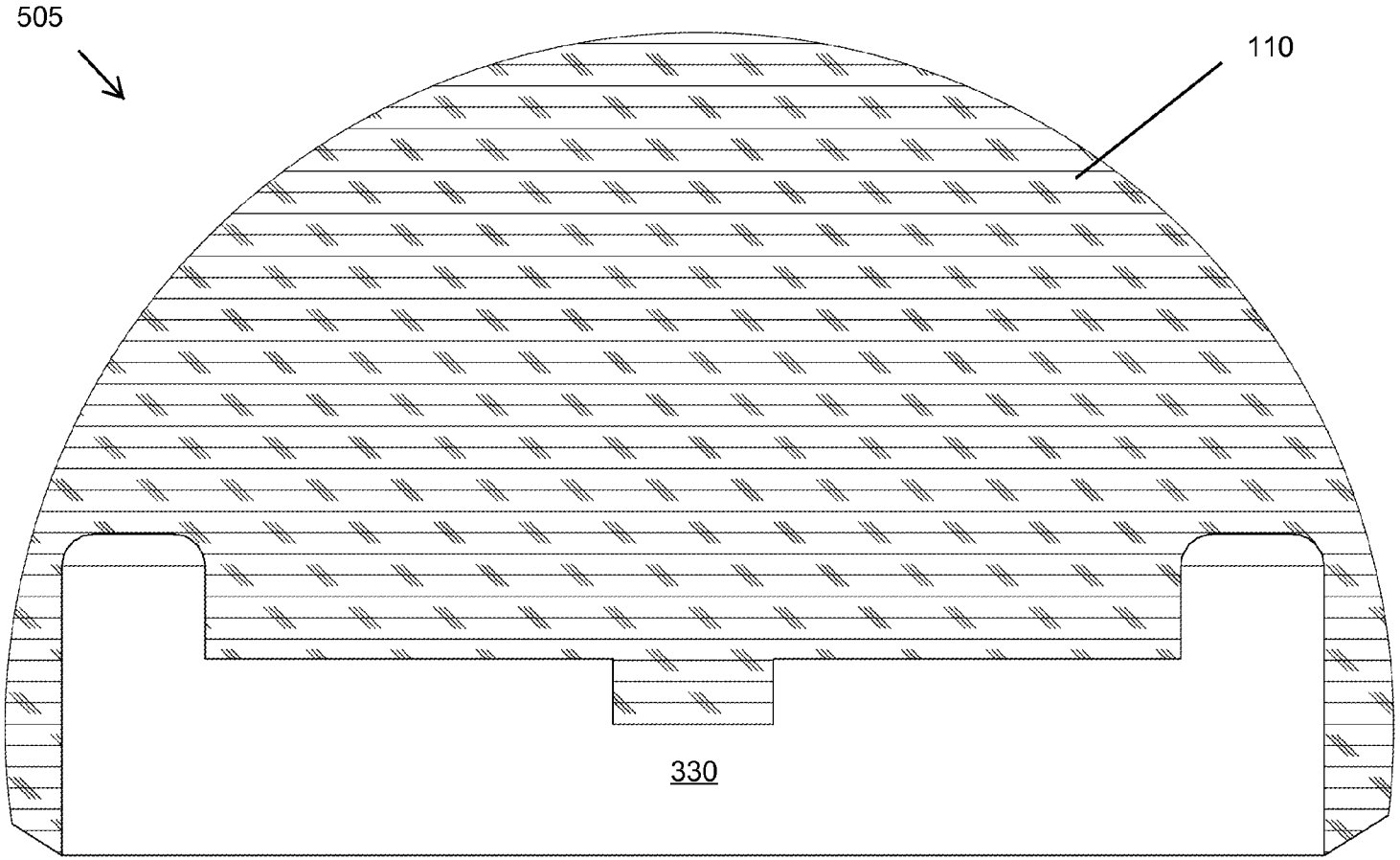
FIG. 5 illustrates a detail view of a portion of the bottom of the tabla.

Rotation of adjustor 320 changes a separation distance between an aperture engagement surface 335 of adjustor 320 and a coupler engagement surface 340 of body 315. Coupler engagement surface 340 generally defines a plane that is parallel to drum head 130. Rotation in a first direction increases the separation distance and rotation in a second direction decreases the separation distance. Changes in the separation distance result in tension changes in connective assembly 155, and thus to drum head 130, by virtue of the coupling of connective assembly 155 to coupler 325 and coupler 325 to coupler engagement surface 340. FIG. 5 illustrates a detail view of a portion 505 of bottom 120 of tabla 100 shown in FIG. 1. Aperture 330 is configured to seat mechanical interface 150 and uniformly distribute tensioning forces to connective assembly 155. There are many different configurations and arrangements for mechanical interface 150, connective assembly 155, and aperture 330 to achieve these goals.

Figure 6:
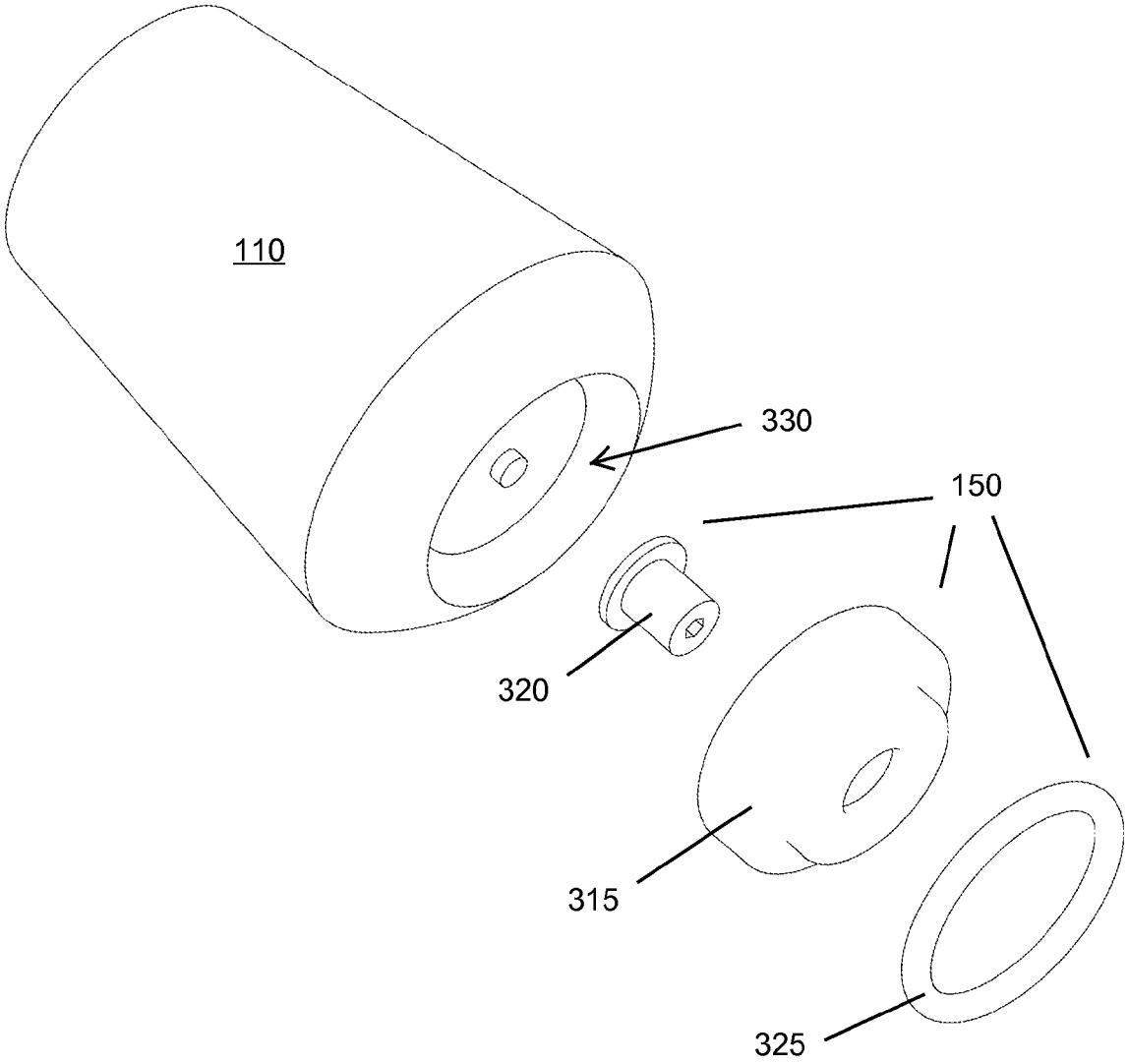
FIG. 6 illustrates an exploded perspective view of the components of the mechanical interface in relation to an unlaced tabla.

FIG. 6 illustrates an exploded perspective view of the components of mechanical interface 150 in relation to tabla 100 without connective assembly 155 and drum head 130. Adjustor 320 is threaded into body 315 and installed into aperture 330. Coupler 325 engages body 315 when connective assembly 155 attaches coupler 325 to drum head 130 with body 315 (including adjustor 320) and body 110 in-between.

Figure 8:
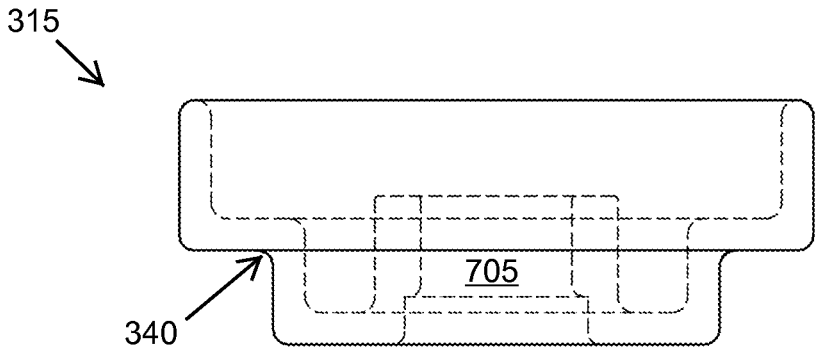
FIG. 8 illustrates a cross-sectional view of the mechanical interface body of FIG. 7.
Figure 7:
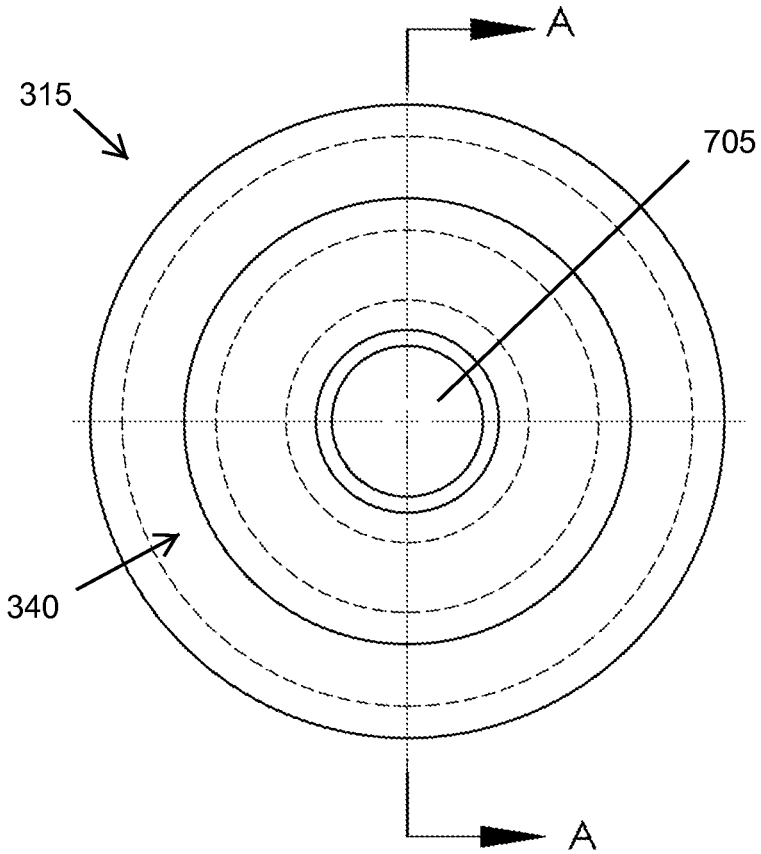
FIG. 7 illustrates a bottom plan view of the mechanical interface body.

FIG. 7 illustrates a bottom plan view of mechanical interface body 315 and FIG. 8 illustrates a cross-sectional view of mechanical interface body 315 of FIG. 7. Body 315 is generally puck-like having a central threaded aperture 705 for receiving adjustor 320. Body 315 transfers and uniformly distributes forces caused by changes in the separation distance to connective assembly 155 through coupler engagement surface 340 engaging coupler 325.

Figure 9:
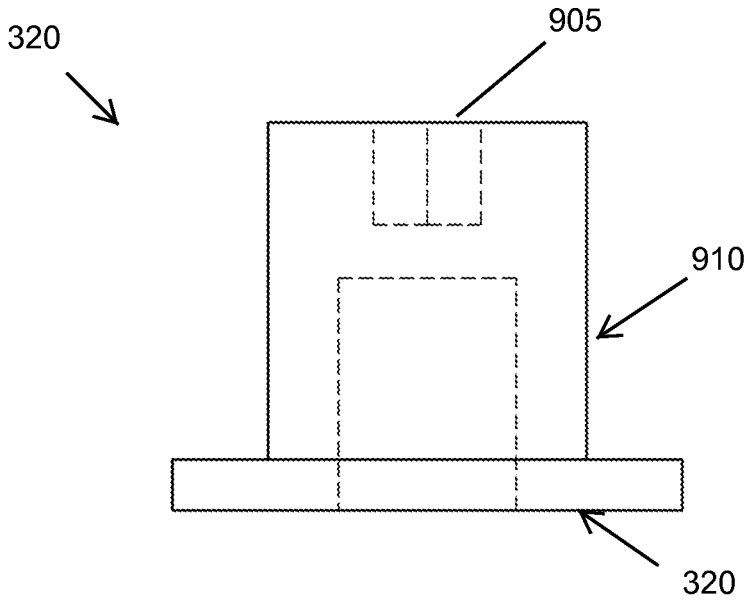
FIG. 9 illustrates a bottom plan view of the mechanical interface adjustor.
Figure 10:
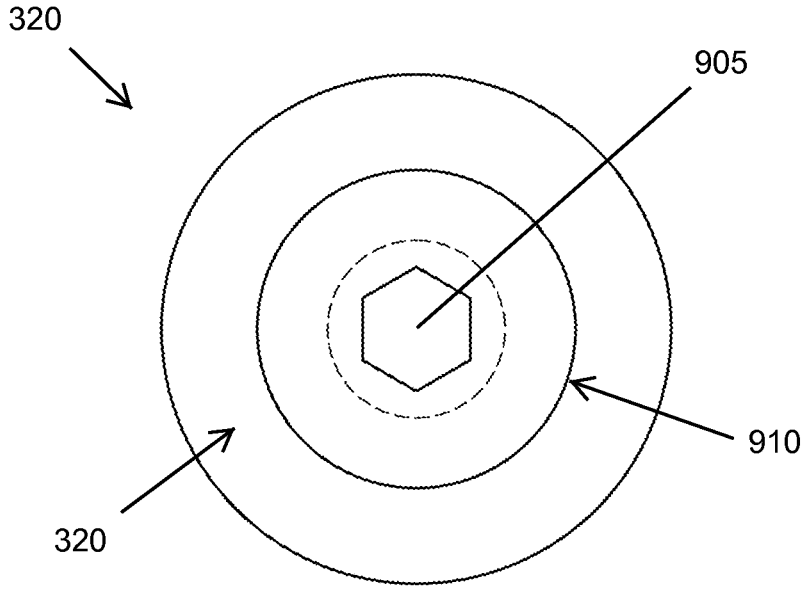
FIG. 10 illustrates a side plan view of the mechanical interface adjustor of FIG. 9.

FIG. 9 illustrates a bottom plan view of mechanical interface adjustor 320 and FIG. 10 illustrates a side plan view of mechanical interface adjustor 320 of FIG. 9. Adjustor 320 includes a tool engagement port 905 (e.g., an aperture with a hexagonal aperture) for receiving a tool that facilitates rotation of adjustor 320 when it is installed into aperture 705 shown in FIG. 7 and loads connective assembly 155. As noted above, adjustor 320 is threadingly engaged to body 315. A mating surface 910 includes a desired screw thread arrangement and aperture 705 includes a complementary mating screw thread arrangement. The thread arrangements are required to sustain the rotation of adjustor 320 under heavy loading of connective assembly 155. The thread arrangement may include a shallow lead and a square threadform to better convert torques of adjustor 320 into linear motions that directly control the separation distance, and indirectly controls the force that connective assembly 155 imparts to drum head 130.

In operation, adjustor 320 is threaded into aperture 705 of body 315 and body 315 is installed into aperture 330 of body 110. Drum head 130 is placed over opening 310. Coupler 325 is located at coupler engagement surface 340 and connective assembly 155 uniformly attaches the perimeter of drum head 130 to the perimeter of coupler 325. Thereafter rotations of adjustor 320 uniformly changes the tension of all segments of connective assembly 155 at the same time. The changes, whether an increase or a decrease in the tension applied to drum head 130, are dependent upon which direction adjustor 320 is rotated and the amount of rotation.

Figure 11:
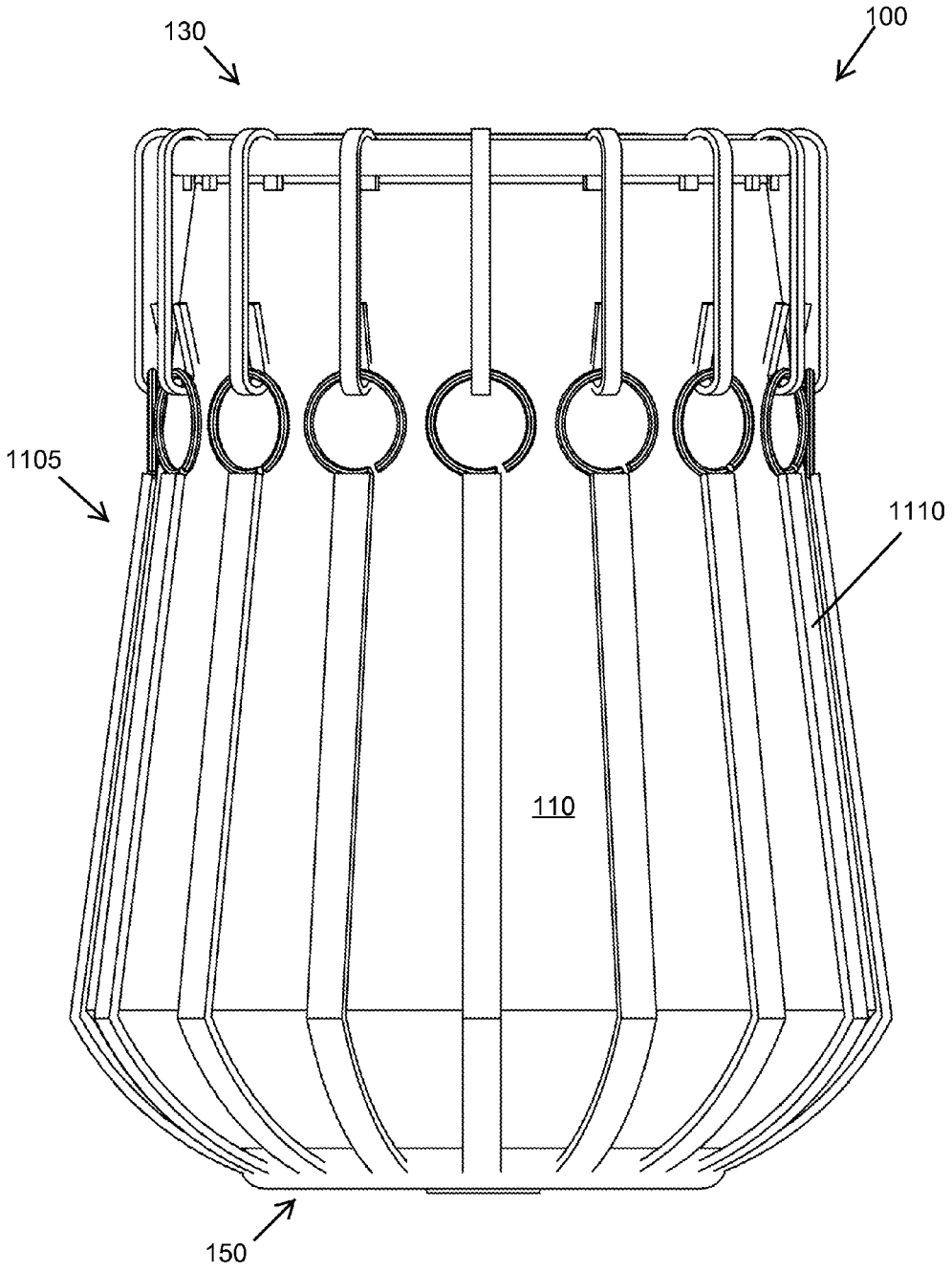
FIG. 11 illustrates a side plan view of an alternative arrangement of a tensioning system for a tabla.

FIG. 11 is a side plan view of an alternative arrangement for a connective assembly 1105 of a tensioning system. Connective assembly 1105 is compatible with mechanical interface 315 described above. Connective assembly 1105 includes a plurality of individual elongate assemblies 1110 that provide a plurality of points of attachment of drum head 130 to coupler 325. Preferably each elongate assembly 1110 is constructed of an inelastic material (inelastic segment implementations of the elastic versions of connective assembly 155 or the like) that does not stretch or demonstrate failure or deformation when tensioning drum head 130 for playing. This tensioning force is a relatively high force that stretches conventional Tabla lacing leather and rawhide straps in a relatively short period of time (e.g., days/weeks). Each elongate assembly 1110 includes a hook, coupler, or engagement structure at each end—one hook engaging drum head 130 and the other hook engaging coupler 325. Connective assembly 1105 enables a user to quickly mount and test a drum head 130 without the time investment required for lacing connective assembly 155 described elsewhere herein.

The system and methods above has been described in general terms as an aid to understanding details of preferred embodiments of the present invention. In the description herein, numerous specific details are provided, such as examples of components and/or methods, to provide a thorough understanding of embodiments of the present invention. Some features and benefits of the present invention are realized in such modes and are not required in every case. One skilled in the relevant art will recognize, however, that an embodiment of the invention can be practiced without one or more of the specific details, or with other apparatus, systems, assemblies, methods, components, materials, parts, and/or the like. In other instances, well-known structures, materials, or operations are not specifically shown or described in detail to avoid obscuring aspects of embodiments of the present invention.

Reference throughout this specification to "one embodiment", "an embodiment", or "a specific embodiment" means that a particular feature, structure, or characteristic described in connection with the embodiment is included in at least one embodiment of the present invention and not necessarily in all embodiments. Thus, respective appearances of the phrases "in one embodiment", "in an embodiment", or "in a specific embodiment" in various places throughout this specification are not necessarily referring to the same embodiment. Furthermore, the particular features, structures, or characteristics of any specific embodiment of the present invention may be combined in any suitable manner with one or more other embodiments. It is to be understood that other variations and modifications of the embodiments of the present invention described and illustrated herein are possible in light of the teachings herein and are to be considered as part of the spirit and scope of the present invention.

It will also be appreciated that one or more of the elements depicted in the drawings/figures can also be implemented in a more separated or integrated manner, or even removed or rendered as inoperable in certain cases, as is useful in accordance with a particular application.

Additionally, any signal arrows in the drawings/Figures should be considered only as exemplary, and not limiting, unless otherwise specifically noted. Furthermore, the term "or" as used herein is generally intended to mean "and/or" unless otherwise indicated. Combinations of components or steps will also be considered as being noted, where terminology is foreseen as rendering the ability to separate or combine is unclear.

As used in the description herein and throughout the claims that follow, "a", "an", and "the" includes plural references unless the context clearly dictates otherwise. Also, as used in the description herein and throughout the claims that follow, the meaning of "in" includes "in" and "on" unless the context clearly dictates otherwise.

The foregoing description of illustrated embodiments of the present invention, including what is described in the Abstract, is not intended to be exhaustive or to limit the invention to the precise forms disclosed herein. While specific embodiments of, and examples for, the invention are described herein for illustrative purposes only, various equivalent modifications are possible within the spirit and scope of the present invention, as those skilled in the relevant art will recognize and appreciate. As indicated, these modifications may be made to the present invention in light of the foregoing description of illustrated embodiments of the present invention and are to be included within the spirit and scope of the present invention.

Thus, while the present invention has been described herein with reference to particular embodiments thereof, a latitude of modification, various changes and substitutions are intended in the foregoing disclosures, and it will be appreciated that in some instances some features of embodiments of the invention will be employed without a corresponding use of other features without departing from the scope and spirit of the invention as set forth. Therefore, many modifications may be made to adapt a particular situation or material to the essential scope and spirit of the present invention. It is intended that the invention not be limited to the particular terms used in following claims and/or to the particular embodiment disclosed as the best mode contemplated for carrying out this invention, but that the invention will include any and all embodiments and equivalents falling within the scope of the appended claims. Thus, the scope of the invention is to be determined solely by the appended claims.

What is claimed as new and desired to be protected by Letters Patent of the United States is:

1. A tensioning assembly for a drum head installed on a proximal end of a drum body, comprising:

a mechanical interface coupled to a distal end of the drum body, said distal end opposite of the proximal end, said mechanical interface including a coupler and a tension control; and a connective assembly, uniformly coupled to the drum head and said coupler, including a plurality of connective elements that extend from said coupler to the drum head wherein said connective assembly is responsive to said tension control to uniformly adjust a tension of said plurality of connective elements all at the same time;

wherein the drum body includes an mechanical interface aperture at said distal end, wherein said mechanical interface includes a mechanical interface body configured complementary to said mechanical interface aperture, wherein said tension control includes a mechanical interface adjustor rotationally disposed in said mechanical interface body and interactive with the drum body converting a rotation of said mechanical interface adjustor into a linear longitudinal motion of said mechanical interface body relative to the drum body, and wherein said coupler includes a ring coupled to said mechanical interface body and to said plurality of connective elements.

2. The tensioning assembly of claim 1 wherein said plurality of connective elements include a collection of a plurality of connective segments of a single elongate member repetitively laced back and forth between the drum head and said coupler.

3. The tensioning assembly of claim 2 wherein said elongate member is selected from one or more of the group consisting of a leather thong, a rawhide strap, a lace, a flat nylon webbing, a nylon rope, a metal wire, a metal cable, a plastic cord, a string, and combinations thereof.

4. The tensioning assembly of claim 1 wherein said plurality of connective elements include a collection of discrete inelastic elongate members, each discrete inelastic elongate member including an engagement structure at each of a first end and a second end, each said first end engaging the drum head and each said second end engaging said coupler.

5. The tensioning assembly of claim 4 wherein said elongate member is selected from one or more of the group consisting of an inelastic lace, an inelastic flat nylon webbing, an inelastic nylon rope, an inelastic metal wire, an inelastic metal cable, an inelastic plastic cord, and combinations thereof.

6. A tabla, comprising:

a drum body defining a longitudinal cavity with an opening at a proximal end;

a drum head disposed over said opening;

a mechanical interface coupled to a distal end of said drum body, said distal end longitudinally opposite of said proximal end, said mechanical interface including a coupler and a tension control; and a connective assembly, uniformly coupled to said drum head and said coupler, including a plurality of connective elements that extend from said coupler to said drum head wherein said connective assembly is responsive to said tension control to uniformly and concurrently adjust a tension of said plurality of connective element;

wherein said drum body includes an mechanical interface aperture at said distal end, wherein said mechanical interface includes a mechanical interface body configured complementary to said mechanical interface aperture, wherein said tension control includes a mechanical interface adjustor rotationally disposed in said mechanical interface body and interactive with said drum body converting a rotation of said mechanical interface adjustor into a linear longitudinal motion of said mechanical interface body relative to said drum body, and wherein said coupler includes a ring coupled to said mechanical interface body and to said plurality of connective elements.

7. The tabla of claim 6 wherein said plurality of connective elements include a collection of a plurality of connective segments of a single elongate member repetitively laced back and forth between said drum head and said coupler.

8. The tabla of claim 7 wherein said elongate member is selected from one or more of the group consisting of a leather thong, a rawhide strap, a lace, a flat nylon webbing, a nylon rope, a metal wire, a metal cable, a plastic cord, a string, and combinations thereof.

9. The tabla of claim 6 wherein said plurality of connective elements include a collection of discrete inelastic elongate members, each discrete inelastic elongate member including an engagement structure at each of a first end and a second end, each said first end engaging the drum head and each said second end engaging said coupler.

* * * * *